US008610363B2

(12) United States Patent
Otake et al.

(10) Patent No.: US 8,610,363 B2
(45) Date of Patent: Dec. 17, 2013

(54) LED LIGHTING DEVICE AND ILLUMINATION APPARATUS

(75) Inventors: Hirokazu Otake, Yokosuka (JP); Kenichi Asami, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 162 days.

(21) Appl. No.: 12/874,282

(22) Filed: Sep. 2, 2010

(65) Prior Publication Data

US 2011/0057578 A1 Mar. 10, 2011

(30) Foreign Application Priority Data

Sep. 4, 2009 (JP) ..... 2009-205087

(51) Int. Cl.
*H05B 37/02* (2006.01)

(52) U.S. Cl.
USPC ..... 315/194; 315/51; 315/291

(58) Field of Classification Search
USPC ..... 315/32, 51, 194, 291
See application file for complete search history.

(56) References Cited

U.S. PATENT DOCUMENTS

| | | | | |
|---|---|---|---|---|
| 3,697,774 | A * | 10/1972 | Pascente | 361/13 |
| 3,881,137 | A * | 4/1975 | Thanawala | 361/113 |
| 4,864,482 | A | 9/1989 | Quazi | |
| 5,811,941 | A | 9/1998 | Barton | |
| 5,834,924 | A | 11/1998 | Konopka | |
| 6,153,980 | A | 11/2000 | Marshall | |
| 6,628,093 | B2 | 9/2003 | Stevens | |
| 6,747,420 | B2 | 6/2004 | Barth | |
| 6,787,999 | B2 | 9/2004 | Stimac | |
| 6,969,977 | B1 | 11/2005 | Smith | |
| 6,998,792 | B2 | 2/2006 | Takahashi | |
| 7,081,709 | B2 | 7/2006 | Pak | |
| 7,102,340 | B1 | 9/2006 | Ferguson | |
| 7,106,036 | B1 | 9/2006 | Collins | |
| 7,164,235 | B2 | 1/2007 | Ito | |
| 7,202,608 | B2 | 4/2007 | Robinson | |

(Continued)

FOREIGN PATENT DOCUMENTS

| | | |
|---|---|---|
| CN | 2310432 | 3/1999 |
| CN | 1711006 | 12/2005 |

(Continued)

OTHER PUBLICATIONS

English language abstract of JP 2008-210537, published Sep. 11, 2008.

(Continued)

*Primary Examiner* — Thuy Vinh Tran
(74) *Attorney, Agent, or Firm* — DLA Piper LLP (US)

(57) ABSTRACT

The present invention provides a pair of input terminals to which AC voltage is input, the AC voltage being phase-controlled by a dimmer for phase-controlling AC voltage of an AC source; a damping circuit which has a resistor inserted to a position, into which input current flows from the AC source via the dimmer in series, and a capacitor and an inductor which form a closed circuit together with the AC source and the dimmer, and suppresses high-frequency vibration generated in the dimmer when a phase control element of the dimmer is turned on; and an LED lighting circuit which rectifies AC voltage phase-controlled and input via the pair of input terminals, converts DC output voltage, which is obtained by rectification, so that the voltage adapts to a load, and lights the LED.

3 Claims, 4 Drawing Sheets

(56) References Cited

U.S. PATENT DOCUMENTS

| | | | | |
|---|---|---|---|---|
| 7,262,559 | B2 | 8/2007 | Tripathi | |
| 7,557,520 | B2 | 7/2009 | Chen | |
| 7,564,434 | B2 | 7/2009 | Kim | |
| 7,595,229 | B2 | 9/2009 | Ihme | |
| 7,656,103 | B2 | 2/2010 | Shteynberg | |
| 7,791,326 | B2 | 9/2010 | Dahlman | |
| 7,804,256 | B2 | 9/2010 | Melanson | |
| 7,855,520 | B2 | 12/2010 | Leng | |
| 7,906,917 | B2 | 3/2011 | Tripathi | |
| 7,976,182 | B2 | 7/2011 | Ribarich | |
| 7,999,484 | B2 | 8/2011 | Jurngwirth | |
| 8,013,544 | B2 | 9/2011 | Negrete | |
| 8,018,171 | B1 | 9/2011 | Melanson | |
| 8,018,173 | B2 | 9/2011 | Shackle | |
| 8,044,608 | B2 | 10/2011 | Kuo | |
| 8,076,867 | B2 | 12/2011 | Kuo | |
| 8,076,920 | B1 | 12/2011 | Melanson | |
| 8,093,826 | B1 | 1/2012 | Eagar | |
| 8,098,021 | B2 * | 1/2012 | Wang et al. | 315/291 |
| 8,102,127 | B2 | 1/2012 | Melanson | |
| 8,134,304 | B2 | 3/2012 | Hsu | |
| 8,212,491 | B2 * | 7/2012 | Kost et al. | 315/247 |
| 8,212,494 | B2 | 7/2012 | Veltman | |
| 2005/0253533 | A1 | 11/2005 | Lys | |
| 2006/0001381 | A1 | 1/2006 | Robinson | |
| 2006/0022916 | A1 | 2/2006 | Aiello | |
| 2006/0071614 | A1 | 4/2006 | Tripathi | |
| 2006/0119181 | A1 | 6/2006 | Namba | |
| 2006/0170370 | A1 | 8/2006 | De Anna | |
| 2006/0192502 | A1 | 8/2006 | Brown | |
| 2006/0238174 | A1 | 10/2006 | Russell | |
| 2006/0261754 | A1 | 11/2006 | Lee | |
| 2007/0030709 | A1 | 2/2007 | Kitagawa | |
| 2007/0069663 | A1 | 3/2007 | Burdalski | |
| 2007/0182347 | A1 | 8/2007 | Shteynberg et al. | |
| 2007/0183173 | A1 | 8/2007 | Wu | |
| 2007/0188112 | A1 | 8/2007 | Kang et al. | |
| 2007/0216320 | A1 | 9/2007 | Grivas | |
| 2008/0012502 | A1 | 1/2008 | Lys | |
| 2008/0054817 | A1 | 3/2008 | Kao | |
| 2008/0074058 | A1 | 3/2008 | Lee et al. | |
| 2008/0180036 | A1 | 7/2008 | Garrity | |
| 2008/0203934 | A1 | 8/2008 | Van Meurs | |
| 2008/0238387 | A1 | 10/2008 | Schmeller | |
| 2008/0258647 | A1 | 10/2008 | Scianna | |
| 2008/0258698 | A1 | 10/2008 | Kitagawa | |
| 2008/0259655 | A1 | 10/2008 | Wei | |
| 2008/0278092 | A1 | 11/2008 | Lys | |
| 2008/0316781 | A1 | 12/2008 | Liu | |
| 2009/0021470 | A1 | 1/2009 | Lee | |
| 2009/0079363 | A1 | 3/2009 | Ghoman | |
| 2009/0116232 | A1 | 5/2009 | Chang | |
| 2009/0121641 | A1 | 5/2009 | Shih | |
| 2009/0122580 | A1 | 5/2009 | Stamm | |
| 2009/0184662 | A1 | 7/2009 | Given | |
| 2009/0184666 | A1 | 7/2009 | Myers | |
| 2009/0195168 | A1 | 8/2009 | Greenfeld | |
| 2009/0295300 | A1 | 12/2009 | King | |
| 2010/0013405 | A1 | 1/2010 | Thompson | |
| 2010/0013409 | A1 * | 1/2010 | Quek et al. | 315/294 |
| 2010/0090618 | A1 * | 4/2010 | Veltman | 315/307 |
| 2010/0207536 | A1 | 8/2010 | Burdalski | |
| 2010/0213845 | A1 | 8/2010 | Aiello | |
| 2010/0289426 | A1 | 11/2010 | Takasaka | |
| 2010/0308742 | A1 | 12/2010 | Melanson | |
| 2011/0012523 | A1 | 1/2011 | Pasma | |
| 2011/0273095 | A1 | 11/2011 | Myers | |
| 2011/0291587 | A1 | 12/2011 | Melanson | |
| 2012/0139431 | A1 | 6/2012 | Thompson | |

FOREIGN PATENT DOCUMENTS

| | | |
|---|---|---|
| CN | 2854998 | 1/2007 |
| EP | 1608206 | 12/2005 |
| EP | 1689212 | 8/2006 |
| EP | 2257130 | 12/2010 |
| JP | 02-284381 | 11/1990 |
| JP | 09-045481 | 2/1997 |
| JP | 10-0064683 | 6/1998 |
| JP | 11-087072 | 3/1999 |
| JP | 2001-210478 | 8/2001 |
| JP | 2002-231471 | 8/2002 |
| JP | 2003-157986 | 5/2003 |
| JP | 2004-119078 | 4/2004 |
| JP | 2004-265756 | 9/2004 |
| JP | 2004-296205 | 10/2004 |
| JP | 2004-327152 | 11/2004 |
| JP | 2005-011739 | 1/2005 |
| JP | 2005-129512 | 5/2005 |
| JP | 2006-054362 | 2/2006 |
| JP | 2006-108117 | 4/2006 |
| JP | 2006-210835 | 8/2006 |
| JP | 2006-269349 | 10/2006 |
| JP | 2007-6658 | 1/2007 |
| JP | 2007-042758 | 2/2007 |
| JP | 2007-189004 | 7/2007 |
| JP | 2007-227155 | 9/2007 |
| JP | 2007-234415 | 9/2007 |
| JP | 2007-281424 | 10/2007 |
| JP | 2007-306644 | 11/2007 |
| JP | 2007-538378 | 12/2007 |
| JP | 2008-504654 | 2/2008 |
| JP | 2008-053695 | 3/2008 |
| JP | 2008-104274 | 5/2008 |
| JP | 2008-210537 | 9/2008 |
| JP | 2008-310963 | 12/2008 |
| JP | 2009-123681 | 6/2009 |
| JP | 2009-218528 | 9/2009 |
| JP | 2009-232625 | 10/2009 |
| JP | 2010-140823 | 6/2010 |
| JP | 2010-277819 | 12/2010 |
| WO | WO 99/56504 | 11/1999 |
| WO | WO 03/096761 | 11/2003 |
| WO | WO 2005/115058 | 12/2005 |
| WO | WO 2006/120629 | 11/2006 |
| WO | WO 2008/029108 | 3/2008 |
| WO | WO 2009/014418 | 1/2009 |
| WO | WO 2009/055821 | 4/2009 |
| WO | WO 2009/119617 | 10/2009 |

OTHER PUBLICATIONS

Machine English language translation of JP 2008-210537, published Sep. 11, 2008.

English language abstract of JP-2008-053695 published Mar. 6, 2008.

Machine English language translation of JP-2008-053695 published Mar. 6, 2008.

English language abstract of JP-2007-538378 published Dec. 27, 2007.

Machine English language translation of JP-2007-538378 published Dec. 27, 2007.

English language abstract of JP 2005-11739 published Jan. 13, 2005.

Machine English language translation of JP 2005-11739 published Jan. 13, 2005.

English language abstract of JP 11-087072 published Mar. 30, 1999.

Machine English language translation of JP 11-087072 published Mar. 30, 1999.

English Language Abstract of JP 2009-218528 Published Sep. 24, 2009.

English Language Translation of JP 2009-218528 Published Sep. 24, 2009.

English Language Abstract of JP 2004-119078 Published Apr. 15, 2004.

English Language Translation of JP 2004-119078 Published Apr. 15, 2004.

English Language Abstract of JP 2007-6658 Published Jan. 11, 2007.

English Language Translation of JP 2007-6658 Published Jan. 11, 2007.

English Language Abstract of JP 2003-157986 Published May 30, 2003.

(56) References Cited

OTHER PUBLICATIONS

English Language Translation of JP 2003-157986 Published May 30, 2003.
English Language Abstract of JP 2008-310963 Published Dec. 25, 2008.
English Language Translation of JP 2008-310963 Published Dec. 25, 2008.
International Search Report issued in PCT/JP2009/055871 on Jun. 9, 2009.
English Language Abstract of JP 2002-231471 Published Aug. 15, 2002.
English Language Translation of JP 2002-231471 Published Aug. 15, 2002.
English Language Abstract of JP 2004-327152 Published Nov. 18, 2004.
English Language Translation of JP 2004-327152 Published Nov. 18, 2004.
English Language Abstract of JP 2005-129512 Published May 19, 2005.
English Language Translation of JP 2005-129512 Published May 19, 2005.
English Language Abstract of JP 2007-234415 Published Sep. 13, 2007.
English Language Translation of JP 2007-234415 Published Sep. 13, 2007.
English Language Abstract of JP 2001-210478 Published Aug. 3, 2001.
English Language Translation of JP 2001-210478 Published Aug. 3, 2001.
English Language Abstract of JP 2006-269349 Published Oct. 5, 2006.
English Language Translation of JP 2006-269349 Published Oct. 5, 2006.
International Search Report issued in PCT/JP2009/055873 on Jun. 9, 2009.
International Preliminary Report on Patentability for International Patent Application No. PCT/JP2009/055871 dated Nov. 18, 2010.
English Translation of Written Opinion of the International Search Authority for International Patent Application No. PCT/JP2009/055871 dated Nov. 18, 2010.
Japanese Office Action issued in JP 2008-076837 on Jul. 6, 2010.
English Translation of Japanese Office Action issued in JP 2008-076837 on Jul. 6, 2010.
English Language Abstract of JP 2006-108117 published Apr. 20, 2006.
Machine Translation of JP 2006-108117 published Apr. 20, 2006.
English Language Abstract of JP 2008-281424 published Nov. 20, 2008.
Machine Translation of JP 2008-281424 published Nov. 20, 2008.
Japanese Office Action issued in JP 2008-076835 on Aug. 24, 2010.
English Translation of Japanese Office Action issued in JP 2008-076835 on Aug. 24, 2010.
Extended European Search Report issued in European Appl. 09011497.6 on Jan. 28, 2010.
English Language Abstract of JP 2004-265756 published on Sep. 24, 2004.
English Language Translation of JP 2004-265756 published on Sep. 24, 2004.
Japanese Office Action issued in JP 2008-076837 on Nov. 24, 2010.
English Translation of Japanese Office Action issued in JP 2008-076837 on Nov. 24, 2010.
English Abstract of JP 2009-232625 published Oct. 8, 2009.
English Translation of JP 2009-232625 published Oct. 8, 2009.
English Abstract of JP 2007-306644 published Nov. 22, 2007.
English Translation of JP 2007-306644 published Nov. 22, 2007.
Extended European Search Report issued in EP 10177426.3 on May 4, 2011.
Extended European Search Report issued in EP 10162031.8 on Jul. 21, 2011.
Chinese Office Action mailed Jul. 21, 2011 in CN 201010178232.8.
English Language Translation of Chinese Office Action mailed Jul. 21, 2011 in CN 201010178232.8.
Japanese Office Action issued in JP 2010-213133 on Jun. 14, 2012.
English Language Translation of Japanese Office Action issued in JP 2010-213133 on Jun. 14, 2012.
English Language Abstract of JP 2009-189004 published Jul. 26, 2007.
English Language Translation of JP 2009-189004 published Jul. 26, 2007.
English Language Abstract of JP 2006-210835 published Aug. 10, 2006.
English Language Translation of JP 2006-210835 published Aug. 10, 2006.
English Language Abstract of JP 2009-123681 published Jun. 4, 20120.
English Language Translation of JP 2009-123681 published Jun. 4, 20120.
Japanese Office Action issued in JP 2010-235474 on Apr. 19, 2012.
English Language Translation of Japanese Office Action issued in JP 2010-235474 on Apr. 19, 2012.
English Language Abstract of JP 2008-504654 published Feb. 14, 2008.
English Language Translation of JP 2008-504654 published Feb. 14, 2008.
Japanese Office Action issued in JP 2010-235473 mailed Jul. 19, 2012.
English Language Translation of Japanese Office Action issued in JP 2010-235473 mailed Jul. 19, 2012.
English Language Abstract of JP 2007-042758 published Feb. 15, 2007.
English Language Translation of JP 2007-042758 published Feb. 15, 2007.
Supplementary European Search Report issued in EP 09725738 on Aug. 17, 2012.
Notice for Corresponding Japanese Patent Application No. 2010-196338 mailed Jul. 12, 2012.
English Translation of Notice for Corresponding Japanese Patent Application No. 2010-196338 mailed Jul. 12, 2012.
Japanese Office Action issued in JP2010-196338 mailed Jul. 26, 2012.
English Language Translation of Japanese Office Action issued in JP2010-196338 mailed Jul. 26, 2012.
European Office Action issued in EP 09725489 mailed Aug. 17, 2012.
English Language Abstract of JP 2006-054362 published Feb. 23, 2006.
English Language Translation of JP 2006-054362 published Feb. 23, 2006.
English Language Abstract of JP 2-284381 published Nov. 21, 1990.
English Language Abstract of JP 09-045481 published Feb. 14, 1997.
English Language Translation of JP 09-045481 published Feb. 14, 1997.
English Language Abstract of JP 10-064683 published Jun. 3, 1998.
English Language Translation of JP 10-064683 published Jun. 3, 1998.
Extended European Search Report issued in EP 10173250.1-1239 on Oct. 19, 2012.
European Office Action issued in EP10175037 on Sep. 7, 2012.
Extended European Search Report issued in EP 1015037 Dec. 15, 2011.
English Language Translation of CN 2854998 published Jan. 3, 2007.
U.S. Appl. No. 12/874,282.
European Search Report issued in EP 10174903.4 on Dec. 5, 2012.
Chinese Office Action issued in CN 201010274066.1 on Mar. 14, 2013.
English Language Translation of Chinese Office Action issued in CN 201010274066.1 on Mar. 14, 2013.
English Language Abstract of CN 1711006 published Dec. 21, 2005.
English Language Abstract of CN 2310432 published Mar. 10, 1999.
Japanese Office Action issued in JP 2009-205087 on Apr. 17, 2013.
English Language Translation of Japanese Office Action issued in JP 2009-205087 on Apr. 17, 2013.

(56) References Cited

OTHER PUBLICATIONS

English Language Abstract of JP 2008-104274 published May 1, 2008.
English Language Translation of JP 2008-104274 published May 1, 2008.
English Language Abstract of JP 2004-296205 published Oct. 21, 2004.
English Language Translation of JP 2004-296205 published Oct. 21, 2004.
English Language Abstract of JP 2010-277819 published Dec. 9, 2010.
English Language Translation of JP 2010-277819 published Dec. 9, 2010.
English Language Abstract of JP 2010-140823 published Jun. 24, 2010.
English Language Translation of JP 2010-140823 published Jun. 24, 2010.
English Language Abstract of JP 2007-227155 published Sep. 6, 2007.
English Language Translation of JP 2007-227155 published Sep. 6, 2007.
U.S. Appl. No. 12/873,744.
U.S. Appl. No. 12/777,303.
U.S. Appl. No. 12/873,348.
U.S. Appl. No. 12/885,053.
U.S. Appl. No. 12/860,528.
U.S. Appl. No. 12/557,179.
U.S. Appl. No. 12/764,995.
U.S. Appl. No. 12/873,759.
U.S. Appl. No. 13/687,973.
European Office Action issued in EP10174903.4 on Aug. 8, 2013.
U.S. Appl. No. 12/777,303 electronically captured on Nov. 4, 2013 between Aug. 4, 2013 through Nov. 4, 2013.
U.S. Appl. No. 12/557,179 electronically captured on Nov. 4, 2013 between Aug. 4, 2013 through Nov. 4, 2013.

* cited by examiner

LED LIGHTING DEVICE AND ILLUMINATION APPARATUS

INCORPORATION BY REFERENCE

The present invention claims priority under 35 U.S.C. §119 to Japanese Patent Application No. 2009-205087 filed on Sep. 4, 2009. The content of the application is incorporated herein by reference in its entirety.

FIELD

The present invention relates to an LED lighting device capable of light control and an illumination apparatus provided with the LED lighting device.

BACKGROUND

A two-wire phase control type dimmer using a phase control element such as a triac is widely used as a dimmer for incandescent bulbs. Therefore, if light from an LED can be controlled with use of the dimmer, a low-power type illumination system with a light control function can be conveniently realized only by exchanging light sources without renewing existing equipment and wiring. However, there actually exist the following problems.

(1) When the LED is lit at a low current level, no self-holding current of the phase control element of the dimmer can be secured, thereby causing flickering in the LED brightness. That is, in the case of lighting the LED at the same brightness, required self-holding current of the phase control element cannot be secured by current flowing in the LED since the current flowing in the LED is smaller than that flowing in an incandescent bulb.

(2) Although the dimmer includes a timer circuit having a time constant circuit for turning on the phase control element at a desired phase, operation current for operating the timer circuit cannot be supplied to the dimmer from the moment when an AC source is turned on. Therefore, the dimmer cannot be operated. Moreover, a converter for driving the LED is not activated in turning on the AC source and it takes time to activate the converter.

An LED lighting device is known which, in order to solve the above problems, includes a dynamic dummy load, which is arranged in parallel with a converter, receives a control signal from the converter and adjusts a load in response to the control signal, and thus makes self-holding current of a phase control element and operation current of a timer circuit of a dimmer flow when each of them is required.

However, an LC filter circuit or a resonant circuit, which is formed by a filter capacitor and a small inductor of an AC source line, inside the dimmer generates high-frequency vibration when the phase control element is turned on. Operation of a triac generally used as a phase control element is switched in switching of conduction and blocking in a manner that a conduction region on a chip is made large or small in accordance with a value and flowing time of current flowing through the chip in the element. When negative current of the high-frequency vibration flows for a short time and a peak value of the current is not smaller than a value of arc-extinguishing current inherent to the phase control element, the phase control element is not turned off. However, it has been understood that when the peak value of the negative current of the high-frequency vibration is smaller than the value of the arc-extinguishing current of the phase control element, required phase control cannot be performed. Regarding this problem, in the prior art, the dynamic dummy load exerts a damping effect to the high-frequency vibration to some extent, but the effect is insufficient.

Thereupon, it is considered that the high-frequency vibration is suppressed by inserting a damping resistor to an input end of the LED lighting device in series and operating the damping resistor as a load of the resonant circuit when current flows into the LED lighting device. A resistance value of the damping resistor is determined based on a resonance frequency of the resonant circuit or source voltage, and the high-frequency vibration is more effectively suppressed as consumption power of the damping resistor becomes larger. However, since the damping resistor is connected to a source line in series, power is constantly consumed during energization and thus a resistance value to be adopted in designing is limited due to heat generation or restriction to consumption power. Consequently, the damping effect to the high-frequency vibration when the phase control element is turned on becomes insufficient.

The present invention aims to provide an LED lighting device, which reduces heat generation and consumption power of a resistor of a damping circuit and has a dimmer capable of reliably operating, and an illumination apparatus including the LED lighting device.

DETAILED DESCRIPTION

An LED lighting device of the embodiment includes: a pair of input terminals to which AC voltage is input, the AC voltage being phase-controlled by a dimmer for phase-controlling AC voltage of an AC source; a damping circuit which has a resistor inserted to a position, into which input current flows from the AC source via the dimmer in series, and a capacitor and inductor forming a closed circuit together with the AC source and the dimmer, and suppresses high-frequency vibration generated in the dimmer when a phase control element of the dimmer is turned on; and an LED lighting circuit which rectifies the AC voltage phase-controlled and input via the pair of input terminals, converts DC output voltage, which is obtained by rectification, so that the voltage adapts to a load, and lights an LED.

Next, a first embodiment will be described with reference to FIGS. 1 to 3.

Figure 1:
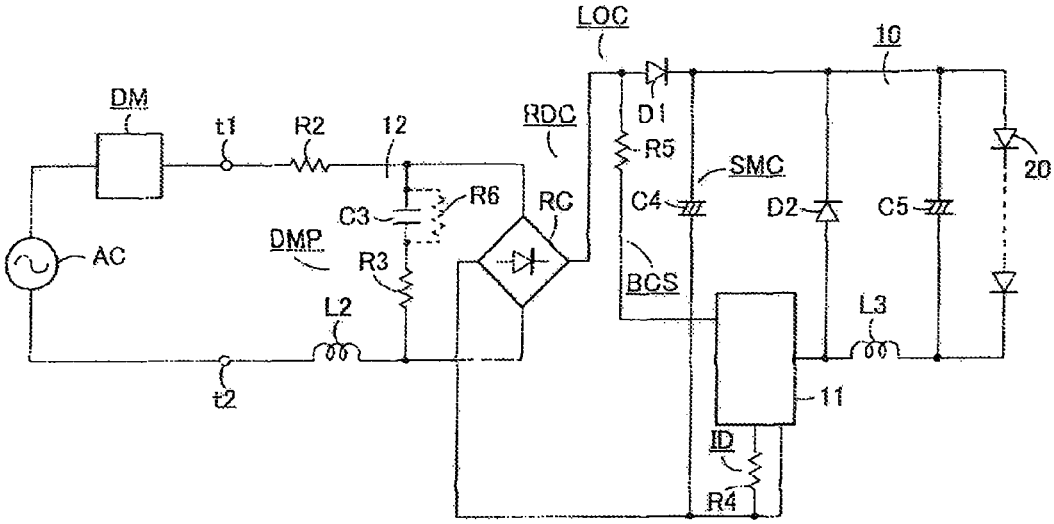
FIG. 1 is a circuit diagram of an LED lighting device of a first embodiment of the present invention.

As shown in FIG. 1, the LED lighting device includes a pair of input terminals t1 and t2, a damping circuit DMP and an LED lighting circuit LOC, the input terminals t1 and t2 are connected to an AC source AC via a dimmer DM, an LED 20 is connected to an output end of the LED lighting circuit LOC and the LED 20 is lit.

The pair of input terminals t1 and t2 are input terminals of the LED lighting device and connected to the AC source AC via the dimmer DM in series.

Figure 2:
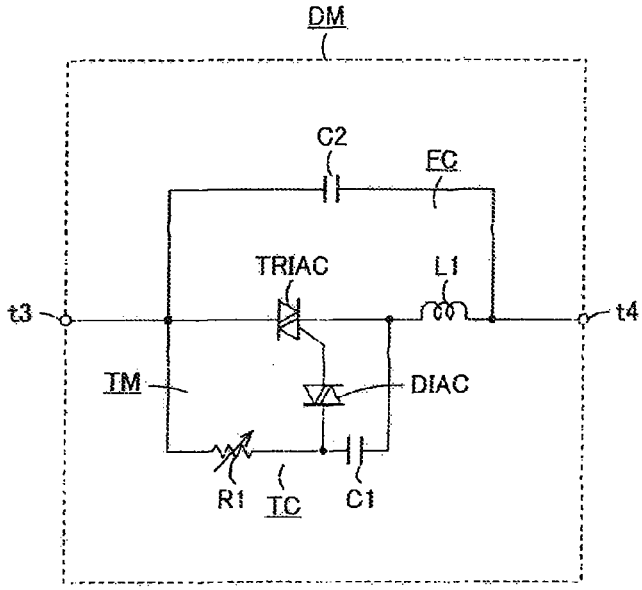
FIG. 2 is a circuit diagram of a dimmer.

As shown in FIG. 2, the dimmer DM is a two-wire phase control type dimmer, and includes a pair of terminals t3 and t4, a phase control element TRIAC, a timer circuit TM and a filter circuit FC. The pair of terminals t3 and t4 are inserted into an AC source line in series.

The phase control element TRIAC includes, for example, a bidirectional thyristor or a pair of thyristors connected in reverse parallel, and main electrodes of the pair of thyristors are connected between the pair of terminals t3 and t4.

The timer circuit TM includes a series circuit of a variable resistor R1, a capacitor C1, a time constant circuit TC connected to the phase control element TRIAC in parallel, and a trigger element DIAC such as a diac having one end connected to an output end of the time constant circuit TC. The other end of the trigger element DIAC is connected to a gate electrode of the phase control element TRIAC.

The filter circuit FC includes an inductor L1 connected to the phase control element TRIAC in series, a capacitor C2 connected to a series circuit of the phase control element TRIAC and the inductor L1 in parallel.

Thus, when AC voltage is applied between the pair of terminals t3 and t4 of the dimmer DM, the time constant circuit TC operates first, and then potential of the output end of the time constant circuit TC reaches the trigger voltage of the trigger element DIAC. Thereby, gate current from the time constant circuit TC flows into a gate of the phase control element TRIAC via the trigger element DIAC and the phase control element TRIAC is turned on. Therefore, a phase angle, that is, a conduction angle, of turn-on of the phase control element TRIAC is changed and a dimming degree is changed, since a time constant is changed by operating the variable resistor R1 and changing a resistance value of the variable resistor R1. Consequently, the dimmer DM changes its output voltage in accordance with a dimming degree determined by operation of the variable resistor R1. Moreover, in the embodiment, since the capacitor C2 and inductor L1 of the filter circuit FC of the dimmer DM mainly resonate transitionally when the phase control element TRIAC is turned on, high-frequency vibration (ringing) is generated in the dimmer DM.

The damping circuit DMP includes resistors R2 and R3, a capacitor C3 and an inductor L2 as shown in FIG. 1.

The resistor R2 is a so-called damping resistor, and inserted to a position, into which input current flows from the AC source AC via the dimmer DM, of a circuit in series. In the embodiment, the resistor R2 is inserted in an AC line connecting an input end of the LED lighting circuit LOC to the dimmer DM. Thus, the resistor R2 can reduce rush current of a smoothing capacitor C4 of a smoothing circuit SMC (described below) of the LED lighting circuit LOC. Additionally, the resistor R2 absorbs high-frequency vibration energy and performs braking operation to high-frequency vibration. Moreover, since the resistor R2 generates heat by passing high-frequency vibration current and input current, preferably, the smallest resistance value is selected in a permissible range.

The capacitor C3 serves a bypassing unit for bypassing the converter 10 and a bleeder current extracting unit BCS (described below) at least of the LED lighting circuit LOC in a high-frequency manner and forming a closed circuit 12 constituted by the AC source AC, dimmer DM, inductor L2, capacitor C3 and resistor R3. Moreover, the resistor R3 is connected to the capacitor C3 in series in the closed circuit 12. The capacitor C3 performs braking operation only to high-frequency vibration current and auxiliary brakes the high-frequency vibration generated in the dimmer DM. In the case where, particularly, the smoothing capacitor C4 is connected at the downstream side in relation to a rectifying circuit RC (described below), since a potential difference of the smoothing capacitor C4 is small depending on a phase angle when the dimmer DM is turned on, a sufficient damping effect cannot be obtained if only the resistor R2 is used. Thereupon, the damping effect can be secured by bypassing current to the capacitor C3. Further, the capacitor C3 of the damping circuit DMP serves as a high-frequency wave leakage preventing circuit which prevents a high-frequency wave of the converter 10 of the LED lighting circuit LOC from leaking to the AC source AC side.

The inductor L2 is connected to a proper position in the closed circuit 12 in series to lower a resonance frequency of the closed circuit 12. That is, since high-frequency vibration transitionally generated in the dimmer DM when the phase control element TRIAC of the dimmer DM is turned on is attenuated vibration in the closed circuit 12, a resonance frequency of the high-frequency vibration in the closed circuit 12 becomes lower, by inserting the inductor L2, than that in the case of not inserting the inductor L2. When the resonance frequency of the high-frequency vibration is lowered, a time width, that is, a period of a current waveform of the high-frequency vibration becomes large. However, since the high-frequency vibration energy is not different from that in the case of not inserting the inductor L2, a peak value of the current waveform of the high-frequency vibration becomes small, and current, which flows between main electrodes of the phase control element TRIAC when the transitional high-frequency vibration is generated, has difficulty becoming lower than the arc-extinguishing current. Consequently, trouble hardly occurs that the phase control element TRIAC, which has been once tuned on, is tuned off by the high-frequency vibration.

Figure 3:
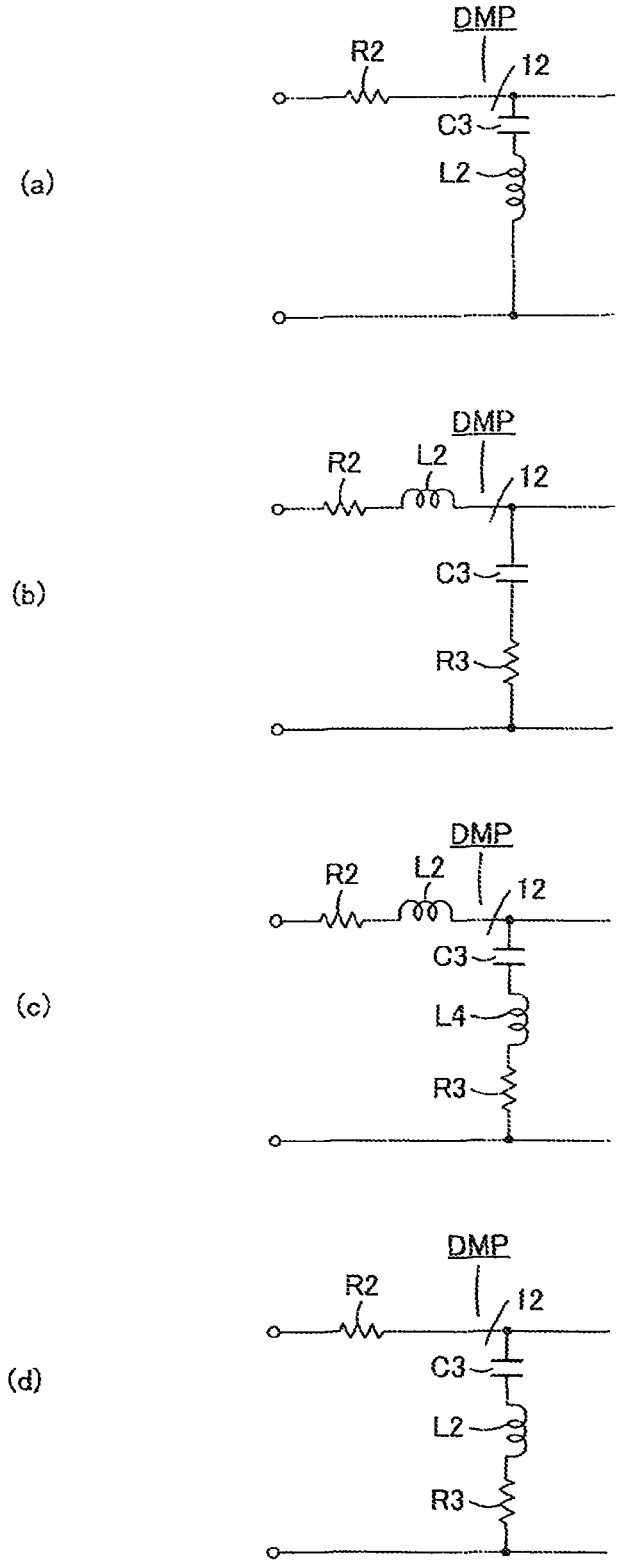
FIGS. 3(*a-d*) show circuit diagrams of other examples of a damping circuit of the LED lighting device.

FIG. 3 shows other examples of the damping circuits DMP. Moreover, the same symbols are attached to the same parts as those in FIG. 1 and description of the parts will be omitted.

In FIG. 3(*a*), compared with FIG. 1, the inductor L2 is connected to the capacitor C3 in series, the capacitor C3 forming the closed circuit 12 which bypasses the LED lighting circuit LOC and the bleeder current extracting unit BCS in the high-frequency manner. According to this example, since current flowing through the LED lighting circuit LOC and the bleeder current extracting unit BCS does not flow in the inductor L2, it is possible to downsize the windings thereof. Consequently, winding work of the inductor L2' becomes easy, a desired number of winding times can be increased, and the inductor L2 having a desired inductance can be used.

In FIG. 3(*b*), compared with FIG. 1, the inductor L2 and the resistor R2 are connected to an AC line, into which input current flows from the AC source AC via the dimmer DM in series. In this case, the inductor L2 of the damping circuit DMP serves as a high-frequency wave leakage preventing circuit for preventing a high-frequency wave of the converter 10 of the LED lighting circuit LOC from leaking to the AC source AC side.

In FIG. 3(*c*), compared with FIG. 3(*b*), a second inductor L4 is connected to a series circuit of the capacitor C3 and the resistor R3 in series. Thus, the number of wire winding times of the inductor L2 connected to a circuit portion, through which input current flows, can be decreased. Additionally, the number of winding times of the second inductor L4 can be decreased similar to that of the inductor L2 shown in FIG. 3(*a*).

In FIG. 3(*d*), compared with FIG. 3(*a*), the resistor R3 is further connected to the series circuit of the capacitor C3 and the inductor L2 in series. The damping effect to resonance current is raised by adding the resistor R3.

Additionally, as shown in FIG. 1, the LED lighting circuit LOC includes the rectifying circuit RC, the converter 10 and the bleeder current extracting unit BCS.

The rectifying circuit RC rectifies AC voltage that is phase-controlled by the dimmer DM and input via the pair of input terminals t1 and t2. Moreover, the smoothing circuit SMC may be optionally added to the rectifying circuit RC. In the embodiment, the smoothing circuit SMC is constituted by the smoothing capacitor C4 connected between DC output ends of the rectifying circuit RC. In FIG. 1, a diode D1 inserted between the output end of the rectifying circuit RC and the smoothing capacitor C4 is used for wraparound prevention. Accordingly, in the embodiment, the rectifying circuit RC, the diode D1 and the smoothing capacitor C4 constitute a rectification DC source RDC.

The converter 10 performs converting operation so that DC voltage obtained from the rectifying circuit RC adapts to the LED 20 of a load, and lights the LED 20. In the embodiment, the converter 10 is constituted by a step-down chopper. That is, the converter 10 includes a switching element, a unit for controlling and driving the switching element, an inductor L3, a freewheel diode D2, an output capacitor C5 and a current detecting unit ID. Moreover, in the above components, both the switching element and the switching element controlling and driving unit or only the unit can be constituted by the LED driving IC 11 made IC compatible. Both the element and the unit are built in the LED driving IC 11 of the embodiment.

That is, the LED driving IC 11 subjects the LED 20 to light control and lights the LED 20 with use of the two-wire phase control type dimmer DM, and has a function of the switching element, a function of controlling and driving the switching element and a function of controlling the bleeder current extracting unit BCS. In order to control and drive the switching element, there are provided at least: a positive characteristic feed-forward controlling unit for monitoring AC voltage phase-controlled by the dimmer DM and converting, in accordance with a value of the AC voltage, output current of the converter 10, for example, into a PWM signal having a variable on-duty; a drive signal generating unit for generating a drive signal of the switching element in accordance with control by the positive characteristic feed-forward controlling unit; and a controlling unit for controlling the bleeder current extracting unit BCS in accordance with operation of the converter 10.

Regarding the step-down chopper constituting the converter 10, a series circuit of the LED driving IC 11, the inductor L3 and the output capacitor C5 is connected to both ends, which are output ends of the rectification DC source RDC, of the smoothing capacitor C4, and the inductor L3, the freewheel diode D2 and the output capacitor C5 are connected so as to form a closed circuit. Increased current flows into a series circuit of the LED driving IC 11, the inductor L3 and the output capacitor C5 from the rectification DC source RDC and the inductor L3 is charged when the switching element of the LED driving IC 11 is turned on. When the switching element of the LED driving IC 11 is then turned off, decreased current flows from the inductor L3 via the free wheel diode D2, and the output capacitor C5 is charged. Both ends of the output capacitor C5 become output ends of the converter 10 and the LED 20 is connected to the ends.

The current detecting unit ID is constituted by a resistor R4 having a small resistance value and detects current, which flows into the converter 10 from the rectification DC source RDC, as current corresponding to load current flowing in the converter 10. A value of the current detected by the current detecting unit ID is input into the LED driving IC 11, and thus an on-duty of the step-down chopper of the LED driving IC 11 is subjected to negative feedback control and the LED 20 of the load can be stably lit. Additionally, the current detecting unit ID cooperates with the LED driving IC 11 so as to contribute to control the bleeder current extracting unit BCS.

The bleeder current extracting unit BCS is connected to the converter 10 in parallel and dynamically extracts, in accordance with operation of the converter 10, respective current necessary for normally operating the dimmer DM to the LED 20. Additionally, the bleeder current extracting unit BCS is constituted in a manner of connecting a bleeder resistor R5 between the DC output ends of the rectifying circuit RC via the LED driving IC 11, and controlled by the LED driving IC 11 as described below.

That is, the bleeder current extracting unit BCS extracts bleeder current, which can operate the timer circuit TM for turning on the phase control element TRIAC of the dimmer DM, during a period from the rise of AC voltage to the time when the phase control element TRIAC is turned on. Moreover, the bleeder current extracting unit BCS extracts holding current of the phase control element TRIAC during an on-period from the time when the phase control element TRIAC is turned on to the end of a half-wave of the AC voltage. In addition, in the bleeder current extracting unit BCS, a first bleeder current circuit for extracting the bleeder current capable of operating the timer circuit TM can be separated from a second bleeder current circuit for extracting the holding current of the phase control element TRIAC.

Next, circuit operation of the LED lighting device will be described.

In FIG. 1, in the case where the dimmer DM is operated and a proper dimming degree is set, when the AC source AC is turned on, the phase control element TRIAC is turned on at a phase corresponding to the dimming degree by bleeder current supplying operation of the bleeder current extracting unit BCS in respective half-wave of AC voltage. The high-frequency vibration generated in the dimmer DM is here braked. The reason for this is that the resonance frequency is lowered by the inductor L2 of the damping circuit DMP thereby relatively lowering the peak value of the high-frequency vibration current, and that the resistor (s) R2 (and R3) absorbs the high-frequency vibration energy and generates heat when the high-frequency vibration current flows through the resistor(s) R2 (and R3) of the damping circuit DMP. Consequently, trouble is effectively prevented from being caused that the high-frequency vibration current becomes smaller than the arc-extinguishing current when leaning toward negative polarity and the phase control element TRIAC, which has been once turned on, is undesirably turned off.

The AC voltage phase-controlled by the dimmer DM is input into the LED lighting circuit LOC from the pair of input terminals t1 and t2, rectified by the rectifying circuit RC, converted into current having a value corresponding to the dimming degree by the converter 10 and supplied to the LED 20 connected to the output end, and the LED 20 is subjected to light control and lit.

Moreover, in lighting the LED 20, into which current smaller than that of an incandescent bulb or bulb type fluorescent lamp flows when the LED 20 is lit, the bleeder current extracting unit BCS extracts current for operating the timer circuit TM before the phase control element TRIAC of the dimmer DM is turned on, and holding current of the phase control element TRIAC after being turned on, and supports stable light control and lighting of the LED 20.

Additionally, in the first embodiment shown in FIG. 1, a resistor R6 for discharge may be connected to the capacitor C3 of the damping circuit DMP in parallel.

Further, in the first embodiment shown in FIG. 1, by selecting constants of the resistors R2 and R3, capacitor C3 and inductor L2, reduction of input current, prevention of a high-frequency noise and reliable operation of the phase control can be obtained as described above. For example, as an example of preferred constant selection, it is cited that a resistor R2 of 47Ω, a resistor R3 of 180Ω, a capacitor C3 of 0.033 μF and an inductor L2 of 1.5 mH are selected.

Next, a second embodiment will be described with reference to FIG. 4. Moreover, the same symbols are attached to the same constitutions as those of the first embodiment and description thereof will be omitted.

In the embodiment, the resistor R2 of the damping circuit DMP is inserted into the circuit only when damping is performed, and is removed from the circuit, into which input current flows, at other times.

The resistor R2 of the damping circuit DMP is inserted into an AC circuit between the rectifying circuit RC and the smoothing capacitor C4 in series. A switch Q1 is connected to the resistor R2 in parallel. In the embodiment, the switch Q1 is constituted by a thyristor, and switched off by a gate circuit G during a predetermined period from the time when the phase control element TRIAC of the dimmer DM is turned on to the time when the high-frequency vibration of the dimmer DM substantially ends. However, the switch Q1 is switched on to short the resistor R2 during a period when input current substantially flows after passage of the predetermined period.

Figure 4:
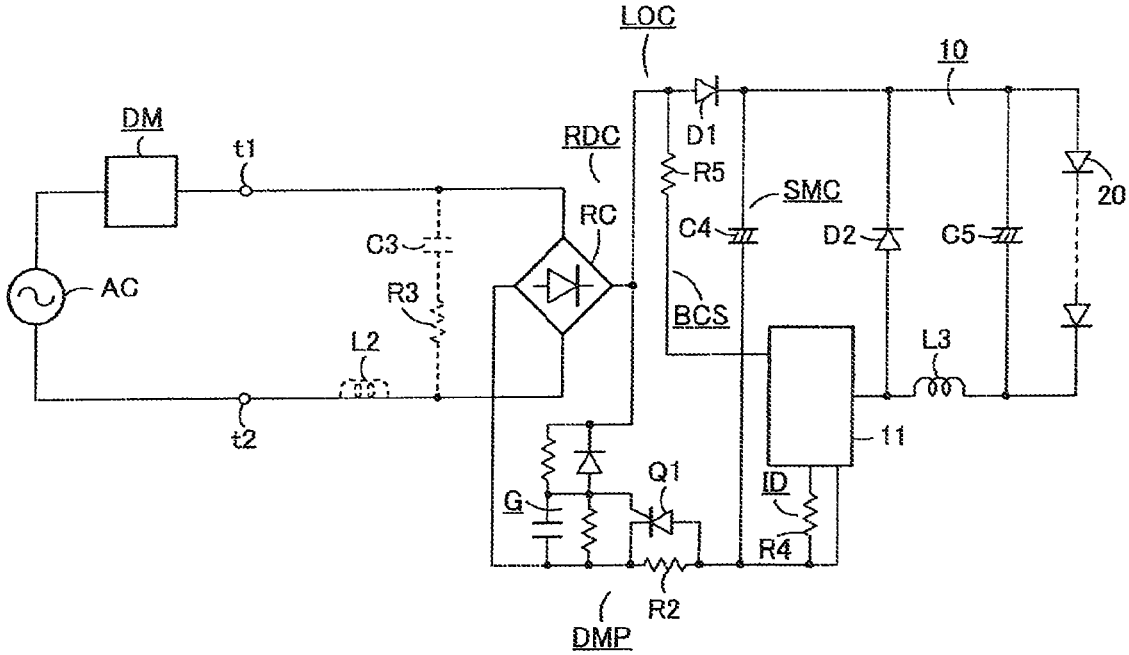
FIG. 4 is a circuit diagram of an LED lighting device of a second embodiment of the present invention.

Moreover, as indicated by the dotted line in FIG. 4, the inductor L2, the capacitor C3 and the resistor R3 can be connected, however, they can be optionally omitted in the embodiment.

Thus in the embodiment, since the resistor R2 of the damping circuit DMP brakes the high-frequency vibration while the phase control element TRIAC of the dimmer DM is turned on and the high-frequency vibration is generated, trouble is effectively prevented from being caused that the high-frequency vibration current becomes smaller than the arc-extinguishing current when leaning toward negative polarity and the phase control element TRIAC, which has been once turned on, is undesirably turned off. Additionally, since the resistor R2 is shorted by the switch Q1 after the high-frequency vibration current is braked, the resistor R2 causes neither power loss nor heat generation when input current flows. Thus, designing can be performed without careful consideration of power loss and heat generation causable by the input current in selecting a resistance value of the resistor R2, and operation of the dimmer DM by high-frequency vibration can be reliably prevented.

Figure 5:
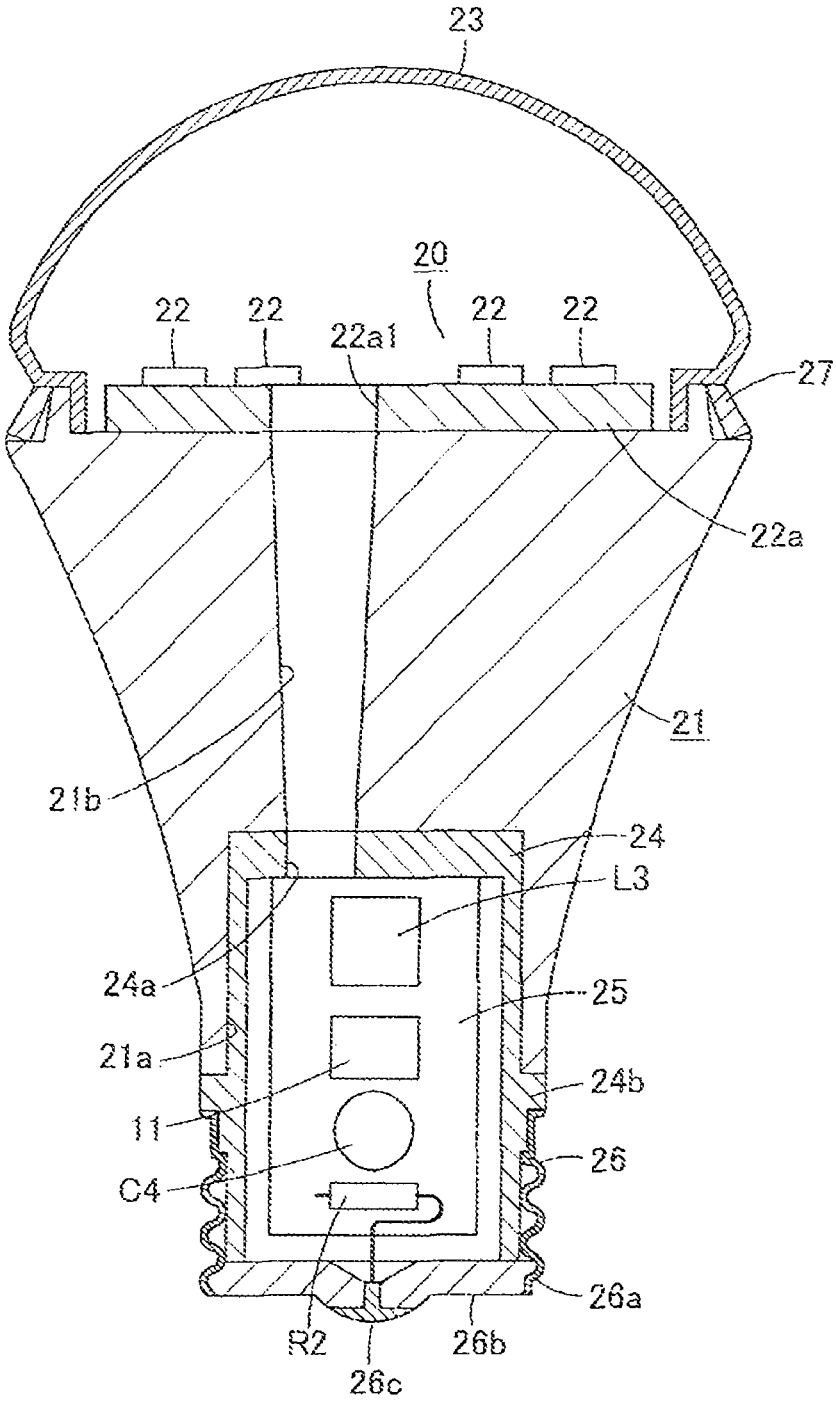
FIG. 5 is a vertical cross sectional view of an LED bulb which is an illumination apparatus including the LED lighting device of each embodiment.

Next, FIG. 5 shows an LED bulb as one form of an illumination apparatus provided with the LED lighting device. Moreover, the same symbols are attached to the same constitutions as those of the above embodiment and description thereof will be omitted.

The illumination apparatus (LED bulb) includes, as main components, an illumination apparatus main body (lamp main body) 21, the LED 20, a globe 23, an insulating case 24, an LED lighting circuit substrate 25 and a cap 26.

The illumination apparatus main body 21 is composed of a heat conductive substance such as aluminum, and forms a circular cone, and in FIG. 5, mechanically supports the LED 20 at an upper end of the main body 21 while forming a heat conductive relationship between the main body 21 and the LED 20. Additionally, the insulating case 24 is housed in a recessed portion 21*a* formed in a lower part of the main body 21. Further, the illumination apparatus main body 21 includes a through hole 21*b* vertically penetrating the illumination apparatus main body 21. Furthermore, the illumination apparatus main body 21 can have a heat radiating fin formed on its outer face so as to increase a heat radiation area.

The LED 20 has a plurality of LED modules 22, and the LED modules 22 are mounted on a circular substrate 22*a*. Additionally, the substrate 22*a* has a wiring hole 22*a*1 at a position corresponding to the through hole 21*b* of the illumination apparatus main body 21. Further, the substrate 22*a* is mainly composed of a heat conductive substance such as aluminum so that heat generated in the LED 20 conducts to the illumination apparatus main body 21 via the substrate 22*a*. The plurality of LED modules 22 are connected to the LED lighting circuit substrate 25 via conductive lines (not shown) wired via the through hole 21*b* and the wiring hole 22*a*1.

The globe 23 is attached to the upper end of the illumination apparatus main body 21 in FIG. 5 so as to surround the LED 20 including the plurality of LED modules 22, protects a charging portion of the LED 20 and mechanically protects the LED 20. Moreover, if necessary, a light controlling unit (not shown), for example, a light diffusing unit may be disposed on or formed integrally with the globe 23 so as to control light distribution characteristics. Moreover, in an external appearance, a ring 27 having an inclined face disposed at a border portion between the globe 23 and the illumination apparatus main body 21 has an outer face having reflectivity, reflects light radiated downward in FIG. 5 from the globe 23 and has a function to correct the light distribution characteristics.

The insulating case 24 is composed of an insulative substance with respect to the illumination apparatus main body 21, for example, plastics or ceramics, and housed in the recessed portion 21*a* of the illumination apparatus main body 21, and houses the LED lighting circuit substrate 25 therein. Additionally, in a state where the insulating case 24 is cylindrical, a lower end thereof is opened, housed in the recessed portion 21*a* of the illumination apparatus main body 21, an upper end thereof is a block end having a wiring hole 24*a* formed corresponding to the through hole 21*b* of the illumination apparatus main body 21 and the case 24 includes a flange portion 24*b* on an outer face of its middle portion. The flange portion 24*b* comes into contact with the lower end of the illumination apparatus main body 21 in FIG. 5 with the insulating case 24 housed in the recessed portion 21*a* of the illumination apparatus main body 21.

The damping circuit DMP and the LED lighting circuit LOC in FIG. 1 or FIG. 4 are mounted on the LED lighting circuit substrate 25, and they are housed in the insulating case 24. In FIG. 5, the circuit components, to which the same symbols as those shown in FIG. 1 or FIG. 4 are attached, are relatively large. The other circuit components are relatively small and omitted, however, these are mounted on the backside of the LED lighting circuit substrate 25 in FIG. 5. The resistor R2 of the damping circuit DMP is constituted by a fuse resistor and arranged in the cap 26.

The cap 26 is an E26 type screw cap attached to a lower part of the insulating case 24, and closes a lower opening end of the insulating case 24. That is, the cap 26 has a cap shell 26*a*, an insulating body 26*b* and a center contact 26*c*. The cap shell 26*a* is attached to the lower part of the insulating case 24, has an upper end brought into contact with the flange portion 24*b* of the insulating case 24 in FIG. 5, and is connected to one of the input terminals t1 or t2 of the LED lighting circuit substrate 25 via a lead wire (not shown). The insulating body 26*b* blocks a lower end of the cap shell 26*a* in the figure of the cap 26*a* and supports the center contact 26*c* so that the center contact 26*c* is insulative to the cap shell 26*a*. The center contact 26*c* is connected to the other input terminal t1 or t2 of the LED lighting circuit substrate 25 via a lead wire (not shown).

As described above, according to the embodiment, since there is provided the damping circuit DMP which includes: the resistor R2 inserted to a position, into which input current flows from the AC source AC via the dimmer DM in series; and the capacitor C3 and inductor L2 which form the closed circuit 12 together with the AC source AC and the dimmer DM, and suppresses high-frequency vibration generated in the dimmer DM when the phase control element TRIAC of the dimmer DM is turned on, a resonant frequency of the high-frequency vibration is lowered, a wave height value of the high-frequency vibration is made small and required braking operation can be obtained even if the resistance value of the resistance R2 is properly made small. Consequently, there can be provided: an LED lighting device which reduces heat generation and consumption power of the resistor R2 of the damping circuit DMP, can maintain a circuit efficiency high in accordance with the reduction, and reliably performs light control operation by the phase control type dimmer DM; and an illumination apparatus including this LED lighting device.

If the fuse resistor is adopted in place of the resistor R2 of the damping circuit DMP, when input current is abnormally increased, the fuse resistor is melted down and thus a protecting operation can be performed against the abnormal increase in the input current. Further, since the illumination apparatus main body 21 includes the cap 26, which is connected to the AC source AC and receives current, and the fuse resistor can be arranged, by being arranged inside the cap 26, at a position located away from the LED 20 lit and having a large amount of generated heat, there occurs no case where the fuse resistor is heated by heat generated by the LED 20 and malfunctions when power not more than melt-down power is supplied. Additionally, since the cap 26 becomes an input terminal of the LED lighting device and the fuse resistor is inserted to a position near the input end on the circuit, wiring becomes easy.

In addition, the illumination apparatus is a concept in which various apparatuses for performing illumination by using an LED as a light source are contained. For example, lighting equipment or a marker lamp is cited which includes an LED bulb or LED light source substitutable for various lamps such as an incandescent bulb, fluorescent lamp and high-pressure discharge lamp as existing lighting sources. Additionally, the illumination apparatus main body is a portion which remains after removing the LED lighting device and LED from the illumination apparatus.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An LED lighting device comprising:

a pair of input terminals to which AC voltage is input;

a dimmer coupled to the input terminals and including a phase control element for phase-controlling AC voltage of an AC source;

a timer circuit for determining a timing for turning on the phase control element; and a filter circuit;

a damping circuit including:

a first resistor connected to a node into which input current flows from the AC source via the dimmer;

a capacitor which is connected to the first resistor and in parallel to the AC source;

a second resistor which is connected in parallel to the AC source and in series with the capacitor; and an inductor connected to the second resistor to form a closed circuit together with the AC source, the dimmer, the first resistor, the capacitor, and the second resistor;

the damping circuit suppressing high-frequency vibration generated in the dimmer when the phase control element of the dimmer is turned on; and an LED lighting circuit including:

a rectifying circuit for rectifying AC voltage input via the pair of input terminals and phase-controlled by the dimmer; and a converter for converting DC output voltage of the rectifying circuit so that the voltage adapts to an LED.

2. An illumination apparatus comprising:

an illumination apparatus main body;

the LED lighting device according to claim 1 disposed on the illumination apparatus main body; and the LED which is connected to an output end of the converter of the LED lighting device being supported on the illumination apparatus main body.

3. The illumination apparatus according to claim 2, wherein the illumination apparatus main body includes a cap which is connected to the AC source and receives current, and in the LED lighting device, the resistor of the damping circuit is constituted by a fuse resistor and housed in the cap.

* * * * *